US005993256A

United States Patent [19]

Shimojyo

[11] Patent Number: 5,993,256

[45] Date of Patent: Nov. 30, 1999

[54] INTEGRALLY MOLDED CAPPED TYPE CONNECTOR

[75] Inventor: Yasuhiro Shimojyo, Isesaki, Japan

[73] Assignee: Hosiden Corporation, Osaka, Japan

[21] Appl. No.: 09/044,145

[22] Filed: Mar. 19, 1998

[30] Foreign Application Priority Data

Mar. 24, 1997 [JP] Japan ..... 9-069648

[51] Int. Cl.[6] ..... H01R 13/58

[52] U.S. Cl. ..... 439/604; 439/865

[58] Field of Search ..... 439/604, 605, 439/606, 586–8, 597–9, 865–8

[56] References Cited

U.S. PATENT DOCUMENTS 4,266,844 5/1981 Chelminski ..... 439/604

5,000,695 3/1991 Nishiyama et al. ..... 439/276

5,647,751 7/1997 Shulman et al. ..... 439/106

*Primary Examiner*—Lincoln Donovan

*Attorney, Agent, or Firm*—Pollock, Vande Sande & Amernick

[57] ABSTRACT

In an integrally molded capped type connector, the insulating body of the connector has a contact hole extending therethrough from the rear end face to the front end face thereof and an inlet aperture leading to the contact hole from the front end face. The contact hole comprises a slot and a pin contact receiving bore extending along a common longitudinal axis and having cross-sectional areas superposed on each other. The forward end of the slot extends across the inlet aperture perpendicularly to the width thereof and beyond the opposite sides of the slot to define protective walls between the opposite widthwise end portions of the slot at its forward end and the front end face of the body. The base of the socket contact is formed on its opposite side surfaces with lugs adapted to fill up the pin contact receiving bore.

9 Claims, 9 Drawing Sheets

31
38
33
36
37

31
36
38R
31W
33a
39
41
32
32a
32b
33
37
31W 31
39
41
32
32b
32a

INTEGRALLY MOLDED CAPPED TYPE CONNECTOR

BACKGROUND OF THE INVENTION

1. Field of the Invention

This invention relates generally to a connector having a plate-like socket contact, and more particularly, to a connector comprising a body having a socket contact and a cap integrally molded on the rear end face of the body so as to cover the connection between the socket contact and a cord.

2. The Prior Art

One example of the prior art connector of the type concerned is illustrated in FIG. 1. The connector shown comprises a generally rectangular body 11 made of resin material having a plurality of contact holes 12 formed therein in a predetermined array. Mounted in each of the contact holes 12 is a socket contact 13 the side view and cross-sectional view of which are shown in FIGS. 2A and 2B, respectively. Each contact hole 12 comprises a vertically elongated slot 12*a* extending from the front end face of the body rearwardly halfway to the rear end face and a transversely elongated slot 12*b* extending through the body from the front end face to the rear end face thereof and traversing the vertically elongated slot 12*a*, with the vertically elongated slot 12*a* and the transversely elongated slot 12*b* being cooperative to define a contact accommodating aperture 12A having a cross-shaped cross-section. The socket contacts 13 are press-fitted or snap-fitted into the respective transversely elongated slots 12*b* from the rear end face of the body 11 to be thereby secured to the body. Connected by soldering to the protuberance 14 of each socket contact 13 protruding from the rear end face of the body 11 is the corresponding core wire 16 of the cord 15, and a cap 17 is integrally molded on the rear end face of the body 11 so as to cover the connections between the socket contacts and the cord.

The socket contact 13, as shown in FIGS. 2A and 2B which are the side view and cross-sectional view of the contact 13 taken along the line 2B—2B in FIG. 2A, respectively, is in the form of a plate having one end portion bifurcated like a fork to define a pair of resilient or spring contact blades 18 adapted to hold the pin contact of a mating connector. The base 19 of the socket contact 13 joining the contact blades 18 have press-fitting detents 21 protruding from the opposite sides thereof. It is to be noted that the protuberance 14 of the socket contact 13 protruding from the rear end face at the other end of the body 11 is slightly bent arcuately along its opposite lateral edges, as shown in a cross-sectional view in FIG. 2B.

When viewed in another aspect, the contact hole 12 formed in the body 11 comprises the contact accommodating aperture 12A which is a forward portion of the hole, and a contact locking slot 12B joining with and extending from the forward aperture 12A to the rear end face of the body 11, as seen in FIGS. 3A, 3B and 3C which are the front view, longitudinal cross-sectional view and rear view of the body 11, respectively. The contact locking slot 12B is a rectangular aperture complementary to the rectangular cross-section of the base 19 of the socket contact 13.

The socket contact 13 is pressed into the contact hole 12 from the rear end face of the body 11 until the detents 21 of the base 19 of the socket contact 13 fitted into the contact locking slot 12B whereby the socket contact 13 is locked to the body 11 while at the same time the locking slot 12B is plugged with the body 11 to prevent resin material from leaking into the contact hole 12 while the cap 17 is molded from resin material.

The spring contact blades 18 of the socket contact 13 are received in the criss-cross contact accommodating aperture 12A with the forward ends of the blades positioned adjacent the front end face of the body 11. The pin contact 24 is in the form of a plate-like pin having a rectangular cross-section as shown in FIG. 4 and is inserted in between the two contact blades 18 such that it forms a criss-cross with respect to the socket contact 13. Accordingly, the vertically elongated slot 12*a* enlarged so as to form a criss-cross with respect to the rearward contact locking slot 12B in the criss-cross aperture 12A has a vertical height sufficient to accommodate the pin contact 24. It is noted that the forward end of the vertically elongated slot 12*a* is provided with a taper 25 to facilitate the insertion of the pin contact 24.

If the contact hole 12 is to be formed in the process of molding the body 11 as described above, it is required to use a mold insert 51 comprising, for example, a criss-cross columnar portion 51A having a criss-cross cross-section complementary in shape to the criss-cross contact accommodating aperture 12A and a rearward plate portion 51B complementary in shape to the contact locking slot 12B, extending from one of the criss-cross legs of the columnar portion 51A, as shown in FIG. 5A. In order to make the mold insert 51 removable from the molded part upon completion of the molding, it is to be understood that the forward end portion of the criss-cross contact accommodating aperture 12A should not be narrowed relative to the rearward plate portion 51B of the mold insert 51, so that the entire forward end portion of socket contact 13 is visible from the exterior of the front end face of the body 11. Consequently, should an excessive force be exerted on the socket contact 13 by a round pin contact, for instance, of a different type of connector plug in an attempt to forcedly insert such round pin into this connector socket by mistake, the socket contact 13 could possibly be deformed.

In order to avert such drawback, it is possible to use a criss-cross mold insert 51 as illustrated in FIG. 5B comprising a vertically elongated rectangular plate portion 51*a* shaped complementarily to the vertically elongated slot 12*a* and extending through the body 11 from the rear end face to the front end face, and ridge portions 51*b* transversely extending from the opposite sides of the plate portion 51*a* and extending longitudinally from the rear end face and terminating short of the front end face of the body, said ridge portions being complementary in shape to the transversely elongated slot 12*b*. It is to be understood that the mold insert 51 shown in FIG. 5B makes it possible to form a contact hole 12 only the vertically elongated slot 12*a* of which is visible from the front end face while the forward end of the transversely elongated slot 12*b* is concealed behind the front end face so that the forward ends of the socket contact 13. In this case, however, it should be noted that a criss-cross opening is formed in the rear end face of the body 11. Consequently, even if the socket contact 13 is pressed from the rear end face of the body into the transversely elongated slot 12*b* of the thus formed contact hole 12, the rearward portion of the vertically elongated slot 12*a* extending from the rear end face into the body remains open as such. This will allow resin material to enter into the contact hole through the exposed rearward portion of the vertically elongated slot 12*a* when molding a cap 17 integrally onto the rear end portion of the body 11, making it difficult to produce a normal connector.

SUMMARY OF THE INVENTION

It is an object of this invention to provide an integrally molded capped type connector which overcomes the aforesaid prior art drawbacks and which is of such configuration as to prevent unnecessary external forces from being exerted on the socket contact as well as preventing the ingress of resin material into the contact hole.

According to this invention, the integrally molded capped type connector connectable with an opponent connector having a plate-like pin contact comprises a body having at least one contact hole extending therethrough from the rear end face to the front end face thereof and an inlet aperture leading to the contact hole from the front end face and having a slightly greater width than that of said pin contact, the contact hole comprising a slot rectangular in cross-section extending from the rear end face to communicate with the inlet aperture short of the front end face of the body and a pin contact receiving bore coextending forwardly with the slot and communicating with the inlet aperture. The pin contact receiving bore having a slightly greater width in cross-section than that of the pin contact and traversing the slot at least thickness-wise thereof. The forward end of the slot extends across the inlet aperture perpendicularly to the width thereof and beyond the opposite sides of the slot to define protective walls between the opposite widthwise end portions of the slot at its forward end and the front end face of the body. A plate-like socket contact is inserted in the slot from the rear end face of the body. The socket contact includes two generally parallel resilient contact blades with the forward ends thereof positioned behind the corresponding protective walls and adapted to hold therebetween the pin contact of the opponent connector, a base joining the rear ends of the two contact blades together and extending rearwardly therefrom, and a terminal portion extending rearwardly from the base to the exterior of the body to be connected with a cord, the base being formed on its opposite side surfaces with lugs adapted to fill up the pin contact receiving bore. A cap is integrally molded on the rear end portion of the body so as to cover the connection between the terminal portion and the cord.

DETAILED DESCRIPTION OF THE PREFERRED EMBODIMENTS

The embodiments of the invention will be described with reference to the accompanying drawings.

Figure 6:
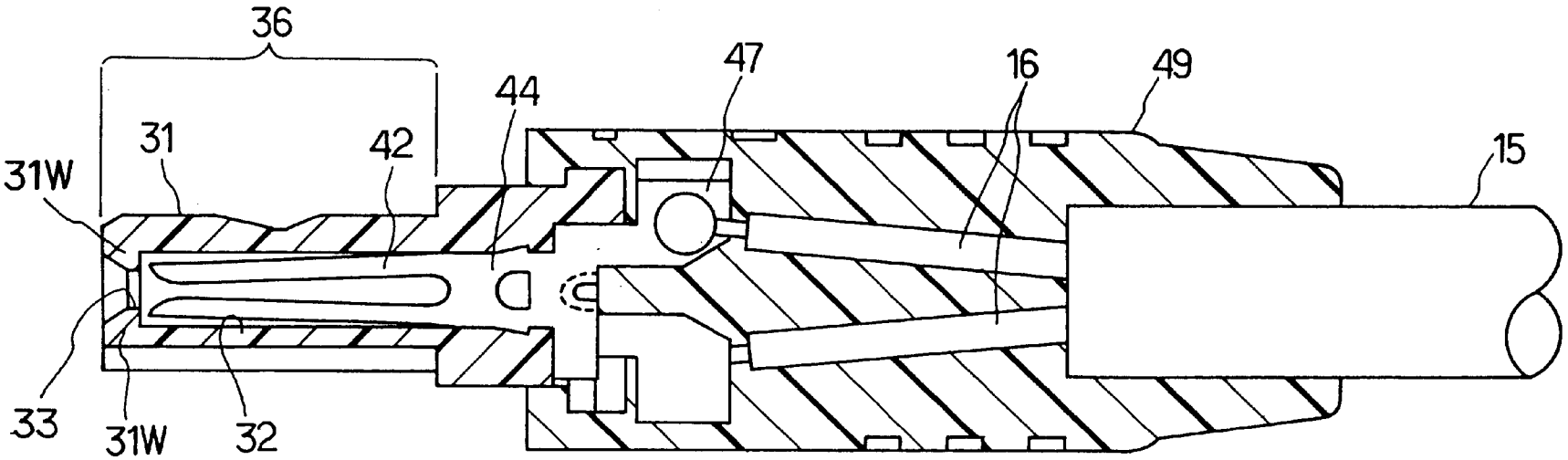
FIG. 6 is a cross-sectional view illustrating one embodiment of the integrally molded capped type connector according to this invention.

FIG. 6 illustrates one embodiment of this invention, and FIG. 7 shows the construction of the body 31 of the connector shown in FIG. 6. The construction of the body 31 will first be described.

Figure 4:
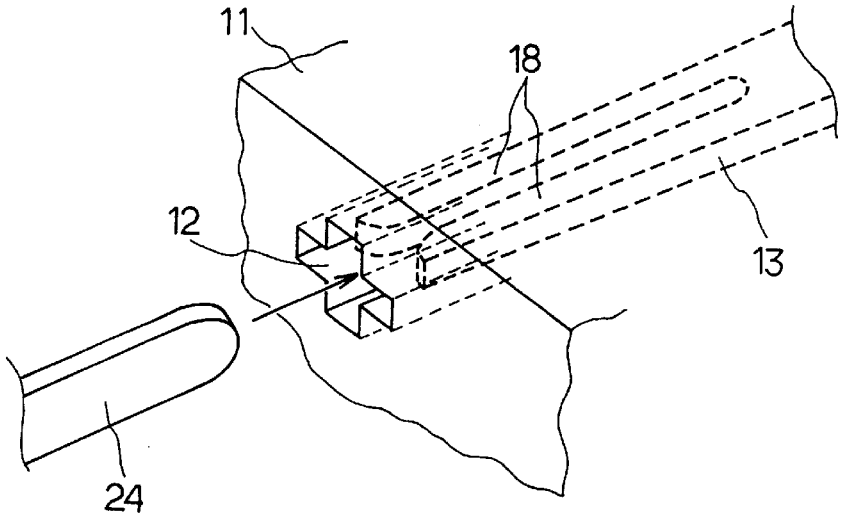
FIG. 4 PRIOR ART
FIG. 4 is an illustration showing how the pin contact is mated with the socket contact.

Contact holes 32 in which respective socket contacts 42 are to be press-fitted are formed in the body 31 such that the holes extend forwardly from the rear end face of the body and terminates short of the front end face so as to leave a wall behind the front end face. The front end wall of the body 31 is formed with inlet apertures 33 each leading to the corresponding contact hole 32. The inlet aperture 33 is in the form of a small aperture, a circular aperture in this example, having a slightly larger width than the maximum width of the plate-like pin contact 24 of the mating connector shown in FIG. 4. The contact hole 32 comprises a pin contact receiving bore 32*a*, circular in cross-section, having the same diameter as the minimum diameter of the inlet aperture 33 and extending continuously through to the rear end face of the body, and a vertically elongated slot 32*b* co-extending with the circular bore 32*a* in superposing relation therewith in a manner traversing the bore diametrically, the slot 32*b* being rectangular in cross-section with a vertical height greater than the diameter of the inlet aperture 33 and being adapted to receive a socket contact 42. The forward end of the inlet aperture 33 is provided with a taper 33*a* to facilitate the insertion of the pin contact 24.

Figure 8:
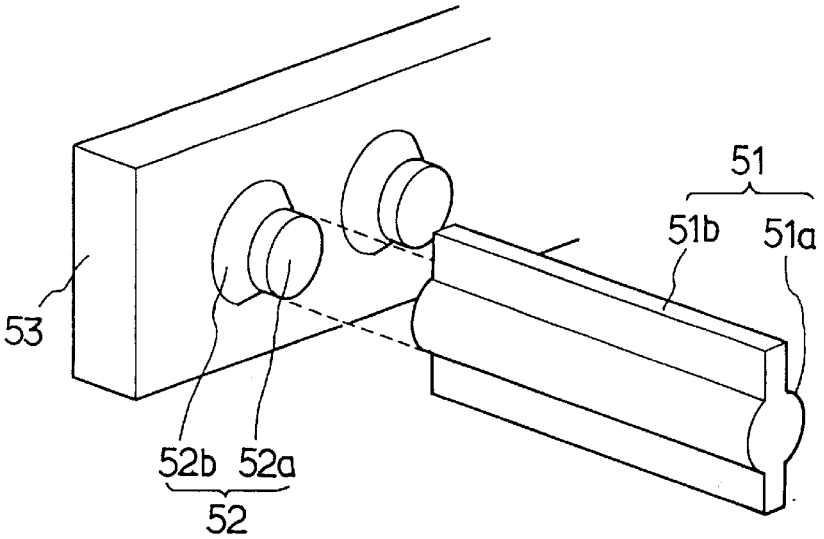
FIG. 8 is a perspective view illustrating one example of the mold insert for forming the contact hole shown in FIG. 6.

Mold inserts 52 and 51 for forming these inlet apertures 33 and contact holes 32, respectively in the body 31 are illustrated in FIG. 8. The mold insert 52 for forming the inlet apertures 33 comprises a plurality of frusto-conical bases 52*b* disposed on the face of a plate-like block 53 in an array corresponding to the inlet apertures 33 to be molded, and round plate sections 52*a* protruding from the tops of the bases 52. Each of the frusto-conical bases 52*b* and each of the round plate sections 52*a* are complementary in shape to the tapered portion 33*a* of the inlet aperture 33 and the main portion of the inlet aperture 33, respectively. The diameter of the round plate section 52*a* determines the diameter of the inlet aperture 33. The mold insert 51 for forming the contact hole 32 comprises a round columnar portion 51*a* having the same diameter as the round plate section 52*a* and rectangular ridges 51*b* extending along the opposite longitudinal sides of the round columnar portion.

In molding the body 31, the mold inserts 52 and 51 are surrounded by a main mold (not shown) for forming the body, with the top faces of the round plate sections 52*a* of the mold inserts 52 on the plate-like block 53 placed in opposed abutment with the front end faces of the respective mold inserts 51 such that the face of the block 53 will form the front end face of the body 31. It is to be understood that the contact hole 32 thus formed will comprise a circular pin contact receiving bore 32*a* and a vertically elongated slot 32*b* superposed on each other around a common central axis, the circular pin contact receiving bore 32*a* having generally the same diameter as that of the inlet aperture 33 as noted above, and the vertically elongated slot 32*b* corresponding to the rectangular cross-sectional shape of the base of the socket contact 42 which will be described later. The vertically elongated slot 32*b* is greater than the front face aperture 33 by the amount in which it protrudes diametrically beyond the confines of the pin contact receiving bore 32*a*. It will thus be appreciated that protective walls or shoulders 31W are defined in the body 31 between the upper and lower sections of the forward end of the vertically elongated slot 32*b* of the contact hole 32 and the front end face of the body 31, whereby the forward ends of the two contact blades of the socket contact 42 which will be described hereinbelow are concealed behind these protective walls 31W to thereby be prevented from being touched from the exterior. In the illustrated example, five contact holes 32 are formed in the body 31.

Figures 7A, 7B, 7C:
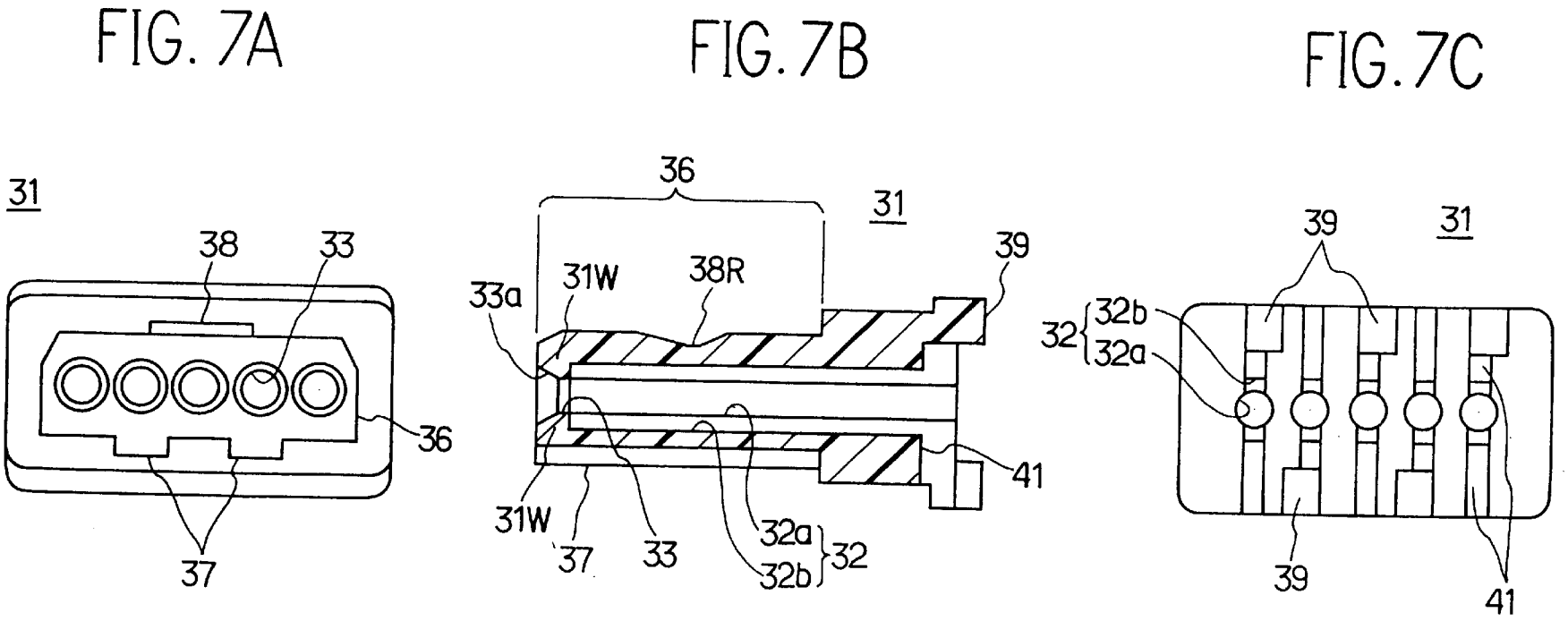
FIG. 7A is a front view of the body of the connector shown in FIG. 6.
FIG. 7B is a cross-sectional view of the body in FIG. 6.
FIG. 7C is a rear view of the body in FIG. 6.

It is to be noted here that the forward portion of the body 31 as shown in FIGS. 7A, 7B and 7C is formed as an insert portion 36 to be inserted into the opponent connector. The insert portion 36 has a ridge or ridges 37 (a pair of ridges in this example) and a ridge 38 formed on the bottom and top surfaces, respectively thereof. An indentation 38R is formed in the upper ridge 38 between the longitudinal ends thereof. Further, as seen in FIG. 7C, protuberances 39 are formed in the rear end face of the body 31 in staggered array in correspondence to the contact holes 32, and grooves 41 extend in opposite directions upwardly and downwardly from the rear end of each of the vertically elongated slots 32*b*.

Figure 9A:
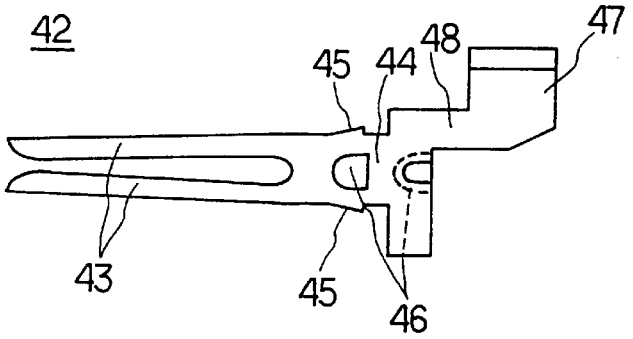
FIG. 9A is a plan view of the socket contact shown in FIG. 6.
Figure 9B:
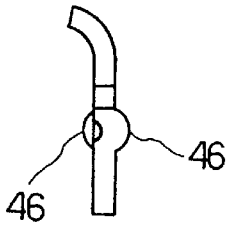
FIG. 9B is a side view of the socket contact shown in FIG. 6.

FIGS. 9A and 9B show the plate-like socket contact 42 to be inserted in the aforesaid vertically elongated slot 32*b*. Like the socket contact 13 described hereinabove, the socket contact 42 comprises a pair of resilient or spring contact blades 43 and press-fitting detents 45 protruding from the opposite sides of the base 44. In the example shown in FIGS. 9A and 9B, semi-circular lugs 46 are formed on the opposite major planar surfaces of the base 44 in longitudinally staggered relation along the central line thereof with the exposed end surfaces of the lugs facing rearwardly. The cross-sections of these two semi-circular lugs 46 have approximately the same radius as the pin contact receiving bore 32*a* of the contact hole 32 described above, so that upon the socket contact 42 being inserted in the vertically elongated slot 32*b*, the semi-circular lugs 46 fill the gaps defined between the major planar surfaces of the base 44 and the peripheral wall of the pin contact receiving bore 32*a*, whereby the ingress of resin material into the contact hole 12 may be prevented when a cap 49 (see FIG. 6) is molded onto the rear portion of the body 31 in a subsequent step. It is to be understood that the lugs 46 may be formed by pressing.

The protuberance 47 of the socket contact 42 to which the core wire 16 is soldered is protruded from the contact by means of an extension 48 in this example as shown in FIG. 9A, and is curved as shown in FIG. 9B.

Figure 10:
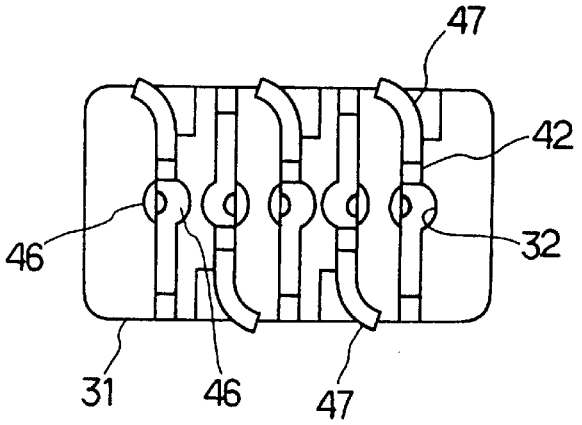
FIG. 10 is a rear view of the body with the socket contacts pressed therein.

The socket contact 42 configured as described above is pressed into the vertically elongated slot 32*b* from the rear end face of the body 31 as shown in FIG. 10 and locked in place therein. It should be noted here that the contact hole 32 is completely plugged with the base 44 of the socket contact 42 and the two semi-circular lugs 46. In this example, as shown in FIG. 10, five protuberances 47 are pressed into the respective slots 32*b* in vertically staggered relation with each other. It is to be appreciated that this arrangement will enhance the easiness in the operation of soldering the core wires 16 of the cord 15 to the protuberances. Subsequent to connecting the core wires 16 of the cord 15 to the respective protuberances 47 of the socket contact 42, a cap 49 is integrally molded over the rear portion of the body 31 so as to cover those connections to complete the connector.

With the construction of the connector as described above, the fork-shaped socket contact 42 may be configured such that the forward ends of contact blades will lie within the contact hole 32 behind the protective walls 31W at the front end face of the body, whereby the possibility may be eliminated of inadvertently exerting excessive external forces on the forward ends of the socket contact 42 to deform them.

While the inlet aperture 33 formed in the forward end face of the body 31 are illustrated as being circular in the embodiment described above, the aperture 33 may be made rectangular. Such example is shown in the front and longitudinal cross-sectional views, respectively of FIGS. 11A and 11B. FIG. 12 illustrates mold inserts 52 and 51 for forming such rectangular inlet apertures 33 and corresponding contact holes 32, respectively. As shown, the mold insert 52 for the rectangular inlet aperture 33 comprises a truncated quadrilateral-pyramidical base 52*b* disposed on the face of a plate-like block 53 for molding the tapered portion 33*a* of the inlet aperture 33, and a rectangular portion 52*a* protruding from the top of the base 52*b* and having a slightly greater cross-section than that of the plate-like pin contact 24 (see FIG. 4). The remainder of the configuration of the body 31 is similar to that of the embodiment illustrated in FIGS. 6 and 7. According to this embodiment, the area of the inlet aperture 33 may be made smaller than in the the embodiment illustrated in FIGS. 6 and 7 to thereby reduce the ingress of dust and foreign matter through the inlet aperture 33.

Figure 5A:
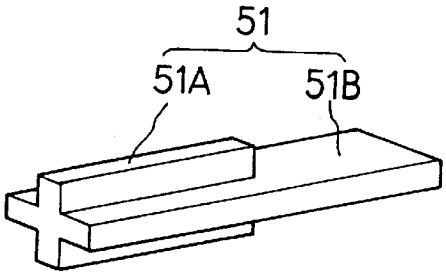
FIG. 5A PRIOR ART
FIG. 5A is a perspective view illustrating one example of the mold insert for forming the contact hole.
Figure 5B:
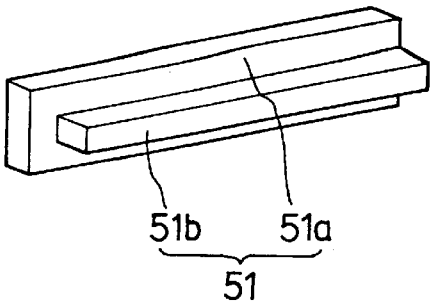
FIG. 5B is a perspective view illustrating another example of the mold insert for forming the contact hole.
Figure 11A:
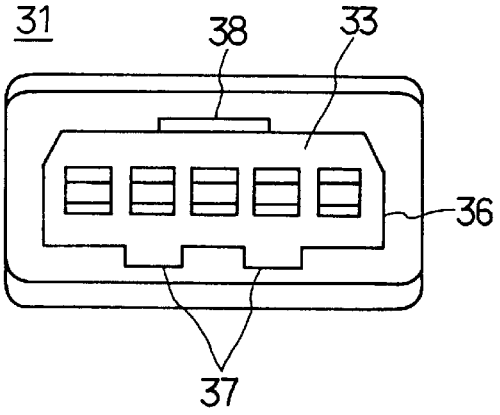
FIG. 11A is a front view of the body illustrating a modified form of the embodiment of FIG. 6.
Figure 11B:
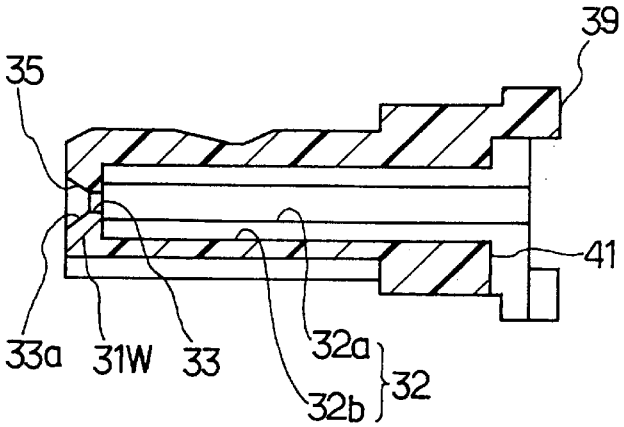
FIG. 11B is a cross-sectional view of the body in FIG. 11A.
Figure 12:
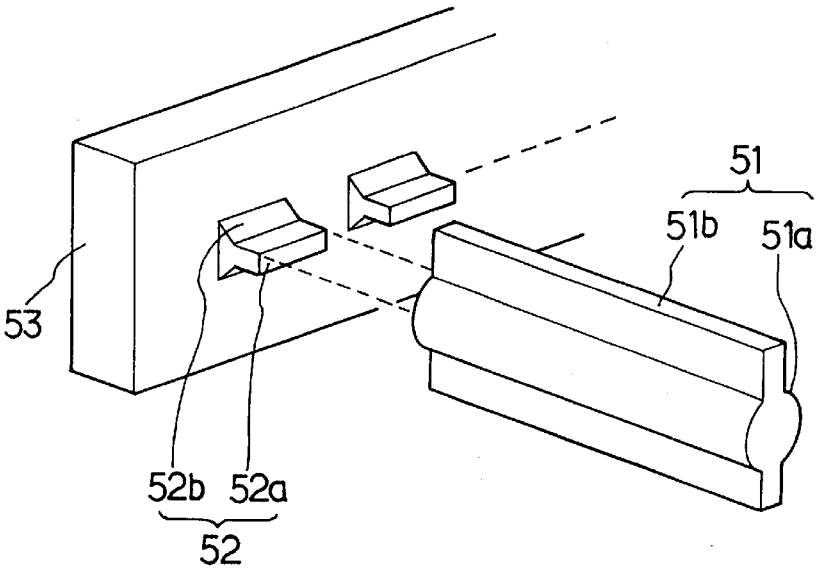
FIG. 12 is a perspective view illustrating one example of the mold insert for forming the contact hole shown in FIG. 11A.

As a further modification of the embodiment of FIGS. 11A and 11B, a transversely elongated slot having the same cross-sectional shape as the inlet aperture 33 may be formed in lieu of the circular pin contact receiving bore 32*a* comprising the contact hole 32. Such modified embodiment is shown in a cross-sectional view in FIG. 13. This embodiment is similar to the embodiments described hereinabove in that protective walls 31W for protecting the forward ends of the contact blades of the socket contact 42 are formed in the body 31 at the front end face thereof, but is different in that a criss-cross opening as described with reference to FIG. 5B is defined in the rear end face of the body 31 by the transversely elongated slot (pin contact receiving bore) 32*a* and the vertically elongated slot 32*b*. Accordingly, in lieu of the two semi-circular lugs 46 as shown in FIGS. 6, 9A and 9B, rectangular tabs 46 are lanced out of the opposite major planar surfaces of the base 44 of the socket contact 42 with the cut end surfaces of the tabs facing rearwardly. The shape and height of these rectangular tabs 46 are such that they will close the voids at their rear ends occurring due to the existence of the transversely elongated slot (pin contact receiving bore) 32*a* when the socket contact 42 is inserted in the contact hole 32. The mold inserts 52 and 51 for forming the inlet aperture 33 and the contact hole 32, respectively in this embodiment are shown in FIG. 14. While the mold insert 52 for forming the inlet aperture 33 is similar to that shown in FIG. 12, the mold insert 51 for forming the contact hole 32 need be one having a criss-cross cross-section.

Figure 13:
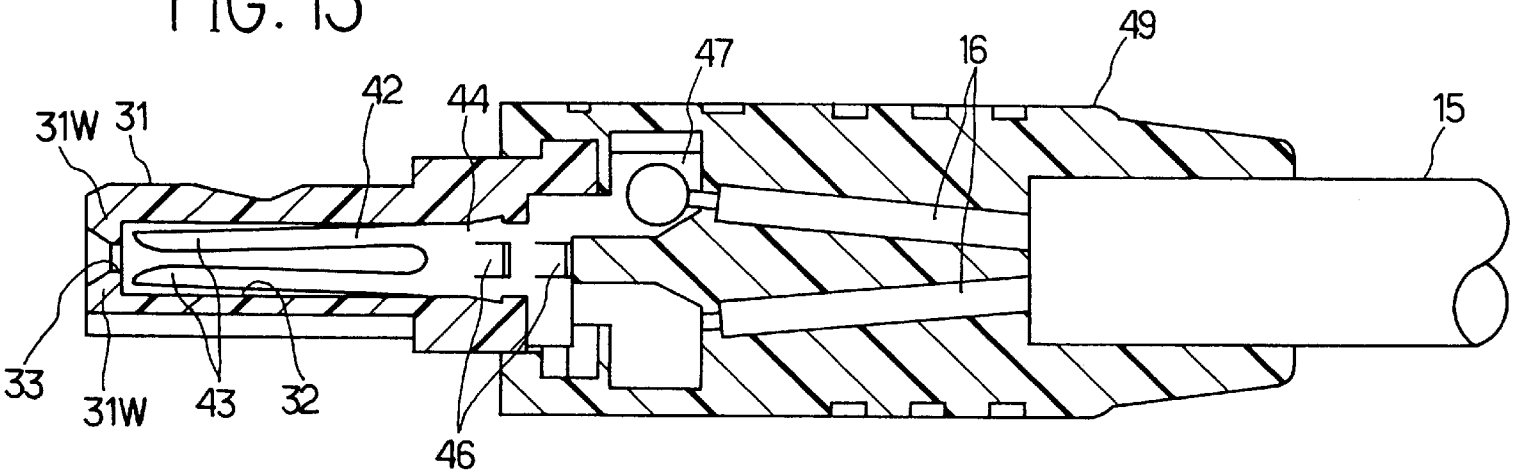
FIG. 13 is a cross-sectional view illustrating another embodiment of the integrally molded capped type connector according to this invention.
Figure 14:
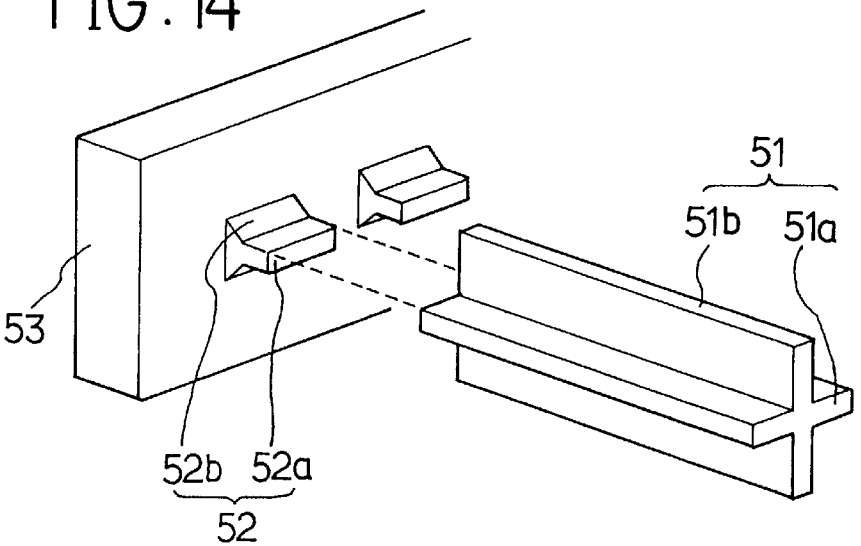
FIG. 14 is a perspective view illustrating one example of the mold insert for forming the contact hole shown in FIG. 13.

In yet another modification, the cross-sectional shape of the contact hole 32 in the embodiment of FIG. 13 may be of a criss-cross form as in FIG. 13 for the forward half portion (contact accommodating aperture) in which the forked spring contact blades 43 of the socket contact 42 are to be positioned, but the rearward half portion (contact locking slot) of the contact hole 32 in which the base 44 of the socket contact 42 is to be positioned may have a cross-section composed of a circle and a vertically elongated rectangle superposed on each other like the embodiment of FIG. 6. The mold insert 51 for forming such contact hole 32 is shown in a perspective view in FIG. 15 from which it is seen that the mold insert 51 comprises a forward half portion having a criss-cross cross-section similar to that shown in FIG. 14 and a rearward half portion having a cross-section composed of a circle and a vertically elongated rectangle superposed on each other like that shown in FIG. 12.

Figure 15:
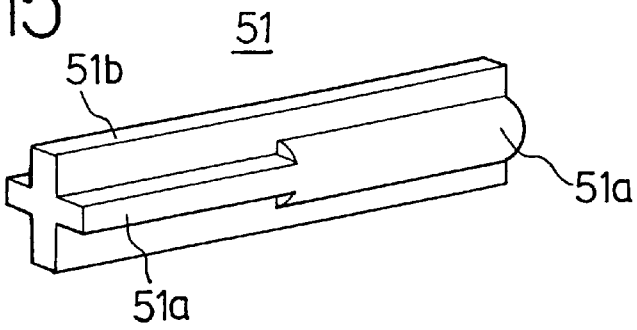
FIG. 15 is a perspective view illustrating an example of the mold insert for forming the contact hole in yet another embodiment of the connector according to this invention.
Figure 16:
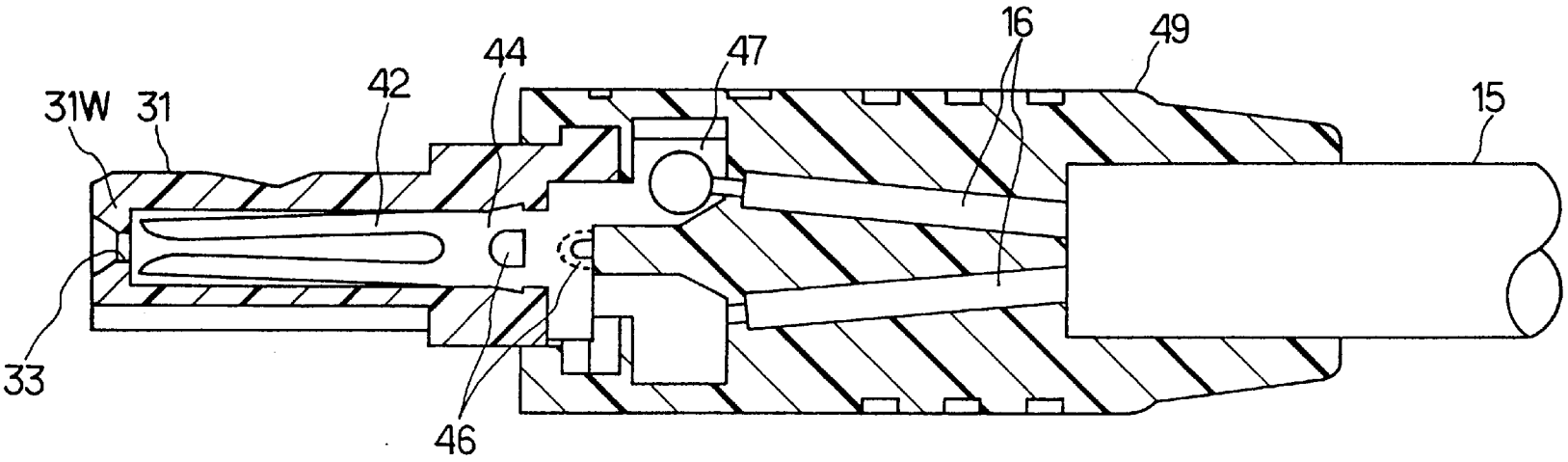
FIG. 16 is a cross-sectional view illustrating the connector having a contact hole formed by the mold insert shown in FIG. 15.

FIG. 16 illustrates an embodiment of the connector having a contact hole 32 formed by the use of the mold insert 51 of FIG. 15. In this embodiment, the lugs 46 formed on the base 44 of the socket contact 42 are of semi-circular cross-section as in the embodiment of FIG. 6. While the semi-circular lugs 46 have the merit of easiness in sealing the pin contact receiving bore 32*a* of the contact hole 32 at its rear end, the rectangular tabs 46 lanced out of the base has the disadvantage of requiring high precision working to obtain tabs that will plug the vertically elongated slot in close fit therewith.

Figure 1:
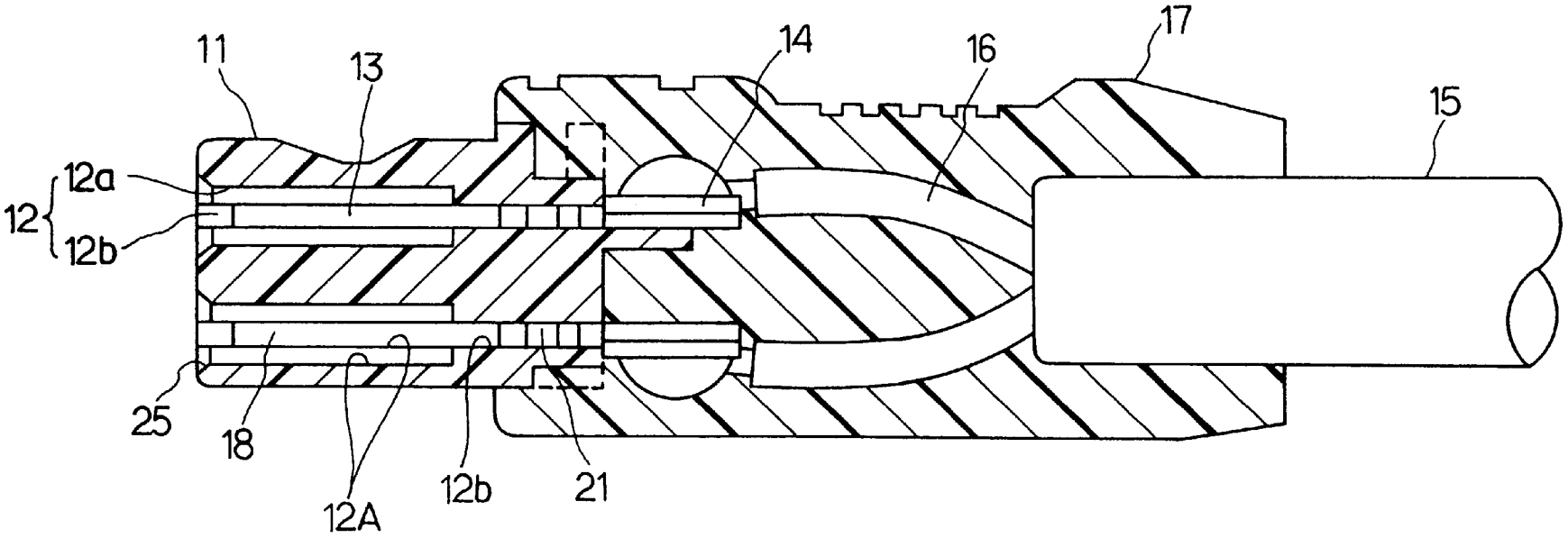
FIG. 1 PRIOR ART
FIG. 1 is a cross-sectional view illustrating the prior art integrally molded capped type connector.
Figure 2A:
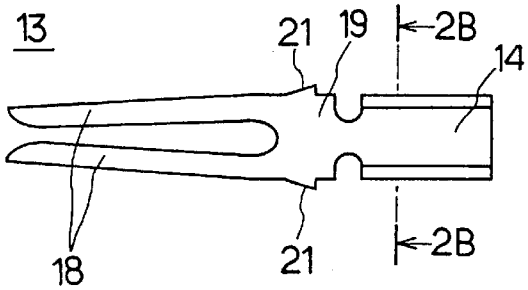
FIG. 2A PRIOR ART
FIG. 2A is a plan view of the socket contact shown in FIG. 1.
Figure 2B:
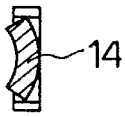
FIG. 2B PRIOR ART
FIG. 2B is a side view of the socket contact shown in FIG. 1.
Figure 3A:
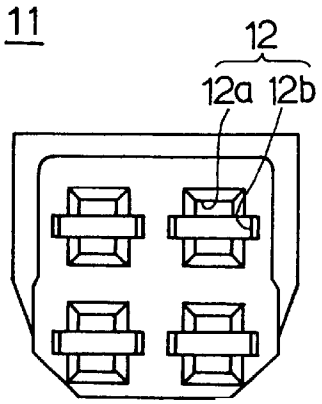
FIG. 3A PRIOR ART
FIG. 3A is a front view of the body of the connector shown in FIG. 1.
Figure 3B:
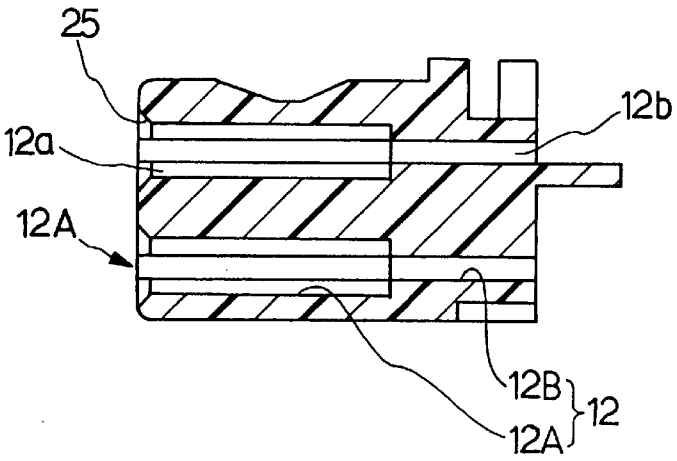
FIG. 3B PRIOR ART
FIG. 3B is a cross-sectional view of the body.
Figure 3C:
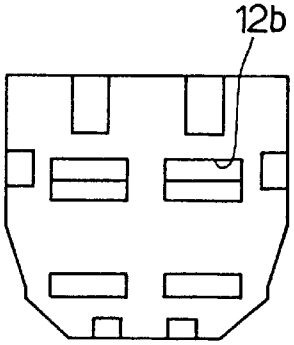
FIG. 3C PRIOR ART
FIG. 3C is a rear view of the body.

Since the inlet aperture 33 in this embodiment may have a rectangular cross-section having a width and height just enough to allow the insertion of the planar pin contact 24 of the opponent connector as in the embodiment of FIG. 11A, the area of the inlet aperture may be reduced as compared to the front opening 22 of the contact accommodating aperture 12A (FIG. 3B) of the conventional connector illustrated in FIG. 1, thereby contributing to prevent ingress of dust and other foreign matter. In addition, this embodiment also provides the advantage like the previously discussed embodiments that the forward ends of the of the socket contact 42 are concealed behind the protective walls 31W to thereby be prevented from being subjected to excessive exterior forces by mistake.

Effects of the Invention

As discussed above, according to this invention, the forward ends of the of the socket contact 42 are positioned behind the protective walls 31W at the front end face whereby the possibility of inadvertently exerting excessive external forces on the forward ends of the socket contact 42 may be eliminated. In addition, since the pin contact receiving bore is stopped up at its rearward end by the lugs or tabs formed on the base of the socket contact, leakage of resin into the contact hole 32 during the molding of the cap may be conveniently prevented without the need for using any separate part or filler.

Furthermore, the area of the inlet aperture 33 may be approximately as small as that of the pin contact of the opponent connector, thereby contributing to prevent ingress of dust and other foreign matter.

What is claimed is:

1. An integrally molded capped connector for establishing a connection with an opposing connector having a plate-like pin contact comprising:

an integrally molded block-shaped body of electrically insulating material, having a front end face and an opposite rear face, said front face including an inlet aperture extending towards said rear face, said rear face having a rectangular slot forming a contact hole, extending towards said front face to a slot end which joins an end of said inlet aperture, said contact hole including a pin contact receiving bore extending the length of said slot along an axis common with an axis of said slot, said contact receiving bore having a cross sectional width traversing the slot cross section greater than the plate like pin contact cross sectional width, said slot end having a width wider than the width of the joined end of said inlet aperture to provide protective walls between said slot end and said front face;

a plate like socket contact including two generally parallel, resilient contact blades, lying in a common plane, inserted in said slot from said rear face so that forward ends of said blades are positioned behind said protective walls, said contact blades receiving therebetween the plate like pin which extends through said inlet aperture and said pin contact receiving bore, a base plate portion of said contact portion joining rear ends of said contact blades and having lugs on side surfaces thereof for closing said contact receiving bore, and a terminal portion extending from said base plate portion outside of said body for connection to a wire of an electrical cord; and a cap integrally molded on the rear portion of said body to cover said connection of said wire with said terminal portion.

2. The connector of claim 1 wherein said pin contact receiving bore is circular, and said lugs are semi-circular with exposed end faces facing rearwardly.

3. The connector of claim 1 wherein said pin contact receiving bore is a rectangular bore having an elongated rectangular cross-section intersecting in a criss-cross form with the cross-section of said slot, and said lugs are rectangular tabs lanced out of said base with the cut end faces of the tabs facing rearwardly.

4. The connector of claim 1 wherein said pin contact receiving bore comprises a rectangular forward half portion having an elongated rectangular cross-section intersecting in a criss-cross form with the cross-section of said slot and a circular rearward half portion, and said lugs are semi-circular having the exposed end faces facing rearwardly.

5. The connector of claim 1, 2, 3 or 4 wherein said inlet aperture is circular and has outwardly tapered peripheral surface.

6. The connector of claim 1, 2, 3 or 4 wherein said inlet aperture is of rectangular shape having a cross-section slightly larger than that of said pin contact, at least the opposed major sides the rectangle having outwardly diverging tapered surfaces.

7. The connector of claim 1, 2, 3 or 4 wherein a plurality of said contact holes are formed in said body, said contact holes being arrayed at equal intervals in a row, the corresponding slots being parallel to each other and oriented perpendicularly to the plane of said array, said socket contacts being inserted in the respective slots, and the major surfaces of said socket contacts being parallel to each other.

8. The connector of claim 7 wherein said terminal portions of said socket contacts extend rearwardly from said body while at the same time said terminal portions are protruded upwardly and downwardly alternately in the array.

9. The connector of claim 7 wherein said body is of generally rectangular shape having top and bottom surfaces parallel to the plane of the array of said contact holes, the top surface of said body being formed with a ridge extending in the front-to-rear direction for guiding said opponent connector as it is inserted over and removed from said body, an indentation for loosely locking with the opponent connector being formed in said ridge in the middle between the front and rear end thereof.

* * * * *